US011441350B1

(12) United States Patent
Jordan

(10) Patent No.: US 11,441,350 B1
(45) Date of Patent: Sep. 13, 2022

(54) TRIPLE SASH EGRESS WINDOW

(71) Applicant: Willaim M Jordan, Bainbridge, GA (US)

(72) Inventor: Willaim M Jordan, Bainbridge, GA (US)

( * ) Notice: Subject to any disclaimer, the term of this patent is extended or adjusted under 35 U.S.C. 154(b) by 0 days.

(21) Appl. No.: 16/988,689

(22) Filed: Aug. 9, 2020

(51) Int. Cl.
*E05D 15/26* (2006.01)
*E06B 3/44* (2006.01)
*E05D 15/18* (2006.01)

(52) U.S. Cl.
CPC ..... *E06B 3/4415* (2013.01); *E05D 15/18* (2013.01)

(58) Field of Classification Search
CPC ..... E06B 3/4415; E05D 15/18
USPC ..... 49/125, 458
See application file for complete search history.

(56) References Cited

U.S. PATENT DOCUMENTS 337,121 A * 3/1886 Blair ..... E06B 3/44 49/121
1,462,645 A * 7/1923 Lancaster ..... E05D 13/14 160/190
1,462,647 A * 7/1923 Lancaster ..... E05D 13/14 49/99
1,751,358 A * 3/1930 Mutch ..... E06B 3/44 160/33
2,707,311 A * 5/1955 Orlin ..... E06B 9/0638 49/125
2,908,051 A * 10/1959 Sparkes ..... E06B 3/925 49/125
3,596,404 A * 8/1971 Moose ..... E06B 3/44 49/249
3,731,430 A * 5/1973 Dallaire ..... E06B 3/42 49/419
4,083,148 A * 4/1978 Saucier ..... E06B 3/28 49/125
4,107,878 A * 8/1978 Baus ..... A47K 3/34 49/125
4,180,942 A * 1/1980 Saucier ..... E06B 3/28 49/125
4,398,373 A * 8/1983 Mancuso ..... E06B 3/4618 49/425
4,428,156 A * 1/1984 Malm ..... E06B 3/223 49/501
4,616,451 A * 10/1986 Glick ..... E04B 7/166 49/125
4,827,685 A * 5/1989 Schmidt ..... E06B 3/26347 49/458
4,944,118 A * 7/1990 Biro ..... E06B 3/44 49/504
5,274,955 A * 1/1994 Dallaire ..... E06B 3/44 49/406
5,446,997 A * 9/1995 Simonton ..... E06B 3/44 49/406

(Continued)

*Primary Examiner* — Jerry E Redman
(74) *Attorney, Agent, or Firm* — Peter Loffler

(57) ABSTRACT

A triple sash hung egress window allows the operable lower sash and middle sash to each travel a greater distance relative to a prior art hung window in order to give more clear space height for a given size window. This additional travel distance is achieved by raising the position of the seating flanges of each sash to be located proximate an upper surface of the top rail of the respective sash. Additionally, the profile of the sill is lowered so that a portion of the flanges of the glazing pocket of the lower sash visibly extend above the sill.

6 Claims, 6 Drawing Sheets

(56) References Cited

U.S. PATENT DOCUMENTS

| | | | | |
|---|---|---|---|---|
| 5,649,389 | A * | 7/1997 | Coddens | E05D 15/22 49/176 |
| 6,276,092 | B1 * | 8/2001 | Neo | E05D 15/0604 49/183 |
| 7,716,875 | B2 * | 5/2010 | Langner | E06B 3/4609 49/458 |
| 7,827,734 | B2 * | 11/2010 | Cox | E06B 5/12 49/63 |
| 8,869,453 | B1 * | 10/2014 | Jordan | E06B 3/4407 49/458 |
| 8,991,099 | B1 * | 3/2015 | Erskine | E05D 15/50 49/127 |
| 10,246,931 | B2 * | 4/2019 | McKenna | E05D 15/18 |
| 10,837,221 | B2 * | 11/2020 | Cohen | E06B 3/26303 |
| 10,851,572 | B1 * | 12/2020 | Flynn | E05D 15/565 |
| 2011/0000138 | A1 * | 1/2011 | Stoutenborough | E05B 5/00 49/449 |
| 2014/0150346 | A1 * | 6/2014 | DeBoer | E05D 13/14 49/414 |
| 2016/0186484 | A1 * | 6/2016 | Nielsen | E06B 7/2305 49/458 |
| 2017/0211310 | A1 * | 7/2017 | Gilkey | E06B 3/22 |

* cited by examiner

TRIPLE SASH EGRESS WINDOW

BACKGROUND OF THE INVENTION

1. Field of the Invention

The present invention relates to a triple sash hung window, including a side hung (slider) window, that has code meeting egress capabilities without the need for a separate casement system as would be required for a triple sash window of the same size.

2. Background of the Prior Art

According to the International Building Code, all bedrooms of a residential dwelling must have egress capabilities directly to the outside of the dwelling in order to allow the occupants in the bedroom to escape immediately to the exterior of the building in case of an emergency such as a fire, and to allow emergency personal to enter the dwelling to rescue any occupants that may still be therein as well as to combat the emergency. Such egress capabilities are typically achieved in one of two manners. One way to achieve code meeting egress is via a door that leads directly to the outside of the dwelling. Barring the availability of a door, the other means to achieve egress is via a window that leads directly to the outside of the dwelling. Such a window must meet certain requirements. Under the current International Building Code, an egress window must have all of the following features: 1) the top of the sill cover at the base of the window cannot be more than 44 inches from the floor; 2) the clear space width, the so-called vent space, must be at least 20 inches in width; 3) the clear space height between the top of the sill cover at the base of the window and the bottom of the bottom rail of the lower sash of the window must be at least 24 inches; and 4) the open vent space area must be at least 5.7 square feet, this last requirement being the minimum vent space needed, in combination with requirements 2 and 3, for a firefighter carrying a breathing tank to be able to enter the structure.

In new construction of dwellings, achieving egress is not usually a problem as the architect simply assures that at least one egress point meeting the International Building Code is designed into each appropriate living space of the dwelling and then assures that the contractor actually builds this egress point according to specifications. The problems occur during remodels of existing dwellings, especially older dwellings that may have been built prior to the adoption of the current International Building Code or any other code for that matter. Many jurisdictions require that during a remodel, especially a sizable remodel, that each bedroom be brought up to the current International Building Code relating to egress. Some jurisdictions go as far as requiring the bedroom be brought up to code during as simple a procedure as replacing a single window within the bedroom either due to life span fatigue of the existing window or to bring in a more energy efficient window such as replacing a single pane window system with a double pane insulated window system.

If the window or windows being installed is a hung window (either a single hung window or a double hung window) problems often arise as many older structures contain bedroom windows that have a relatively short height. Such short heights were common in construction techniques decades ago for a variety of reasons. Modern hung windows allow the clear space height of the window to be substantially less than 50 percent of the overall height of the window, despite the fact that the movable sash (or the lower sash in the case of a double hung window) is about 50 percent of the overall window height. This is due to the fact that the meeting rails of the two sashes (the top rail of the lower movable sash and the bottom rail of the upper sash (non-movable if single hung and movable if double hung)) substantially overlap in order to reduce the visual blockage of these meeting rails. As the lower sash is raised to its maximum height, its top rail abuts the head of the window frame, such head reducing travel of the lower sash. In this position, the majority, if not all of the bottom rail of the lower sash is below the bottom rail of the upper sash (when the upper sash is closed in the case of a double hung window). This under hang of the bottom rail of the lower sash below the bottom rail of the upper sash results in the vent space being substantially less than 50 percent of the overall window height. Accordingly, if the egress requirement calls for a clear space height of 24 inches, the overall height of the window must be must greater than 48 inches in order to achieve this clear space requirement.

To address this problem, one of two steps is typically taken, aside from not performing the remodel, which remodel may be required for a variety of reasons. One step is to increase the height of the overall rough opening for the window in order to allow a window with a suitable height that will allow the window to achieve the appropriate clear space height needed to comply with egress codes. However, such increase in window height tends to be costly. Not only must the window header be raised, which is itself difficult, but the remainder of rough opening that is torn out must also be repaired, which includes both interior and exterior finishing, often requiring a variety of tradesman to come in to complete this task. Depending on the particular structure involved, increasing the height of the rough opening may not even be feasible at almost any cost.

The other common solution employed to obtain sufficient clear space height of the window system is to put a casement feature on the single hung (or double hung) window, so that for code meeting egress, the window functions as a casement window wherein both sashes pivot as a unit about one of the side rails of the window frame (or the top rail of the window frame if the code meeting egress casement is an awning style casement). Such casement systems substantially clear both sashes of the window opening and give substantially all of the window height as clear space height in order to meet egress code. This solution, while widely deployed, has its own problems.

Adding casement features to a hung window system adds additional structure and thus additional costs to the window system. The knuckles of the casement system must be installed on each sash (or the top sash if employing an awning style casement), while a pivot pin must be installed within the knuckles. If a true casement window style (side pivot) is employed, an additional frame element must be overlaid on one of the side rails of the bottom sash so that the window's knuckles are axially aligned. All these features add complexity and cost to the window system.

After the window is installed, other tradesmen continue to work at the job site, especially interior finishing tradesmen, that often bang against the window during normal work performance, or as is often the case, use the window for ingress and egress during the work day. This often causes the casement portion of the window system to go out of balance, requiring the window installer to return after departure of such tradesmen to rebalance the window. Additionally, as such casement additions are designed only for egress and not to regularly functional as a casement window, the casement components tend to be inferior in construction in relation to standard casement components that must stand up to regular repeated use. As such, the casement operation of the hung window tends to be a single use feature of the window, to be used only during emergencies. Unfortunately, in many deployments, such as college dormitories, the occupants of the dwelling use the casement feature on a regular basis, even to the point of using the window for ingress and egress (some college parties can get wild) so that the window quickly gets out of square with its frame to the point that the casement portion of the window cannot close, requiring the time and expensive of a service call.

What is needed is a hung window that can be retrofitted into an existing window opening during window replacement, which hung window meets the clear space height requirements for egress of the applicable code, wherein a prior art window of similar size would not achieve the clear space height. Such a hung window must not rely on a secondary window opening system so as to reduce the overall costs of the window manufacture and after installation maintenance costs. Such a window must be relatively straightforward to install.

SUMMARY OF THE INVENTION

The triple sash egress window of the present invention addresses the aforementioned needs in the art by providing a typical triple sash hung window (either double hung or triple hung) that achieves a greater clear space height relative to a comparable prior art triple sash window so that the present invention meets clear space height egress codes where a comparable prior art triple sash window would not so achieve. The triple sash egress window does not rely on a secondary opening system, such as a casement system (or awning), to achieve this clear space height in order to reduce manufacturing costs relative to secondary opening window systems. This also eliminates maintenance costs of such secondary opening systems. The triple sash egress window is of relatively simple design and construction so that it is similar in cost to comparable prior art triple sash windows in order to make the present invention economically attractive to potential consumers that require code meeting egress clearance heights for a hung window. The triple sash egress window is installed in similar fashion relative to a comparable prior art hung window The triple egress window of the present invention is comprised of a frame that has a sill with a sill pocket located at a base of the frame. The frame has a frame top located on an opposing end of the frame relative to the base. An upper sash has an upper top rail and an upper bottom rail and is disposed within the frame such that the upper top rail is located proximate the frame top. The upper bottom rail has an upper bottom surface facing toward the base such that a middle seating pocket is located along a first length of the upper bottom rail proximate the upper bottom surface. A movable lower sash has a lower top rail and a lower bottom rail and is slidably disposed within the frame. The lower top rail has a lower top surface facing the frame top such that a lower seating flange extends along a second length of the lower top rail proximate the lower top surface. A movable middle sash has a middle top rail and a middle bottom rail and is slidably disposed within the frame between the lower sash and the upper sash. The middle top rail has a middle top surface facing the frame top such that a middle seating flange extends along a second length of the middle top rail proximate the top surface. The middle bottom rail has a middle bottom surface facing toward the base such that a lower seating pocket is located along a first length of the middle bottom rail proximate the middle bottom surface. The hung window is slidable between a closed position wherein the lower bottom rail of the lower is seated within the sill pocket and the lower seating flange is seated within the lower seating pocket and the middle seating flange is seated within the middle seating pocket, and a fully open position wherein the lower top rail of the lower sash and the middle top rail of the middle sash each abut the frame top such that in the fully open position the upper bottom rail, the middle bottom rail, and the lower bottom rail all substantially coextend with one another. The upper bottom rail and the middle top rail do not substantially coextend with one another whenever the hung window is in the closed position as a portion of the middle top rail extends below the upper bottom surface of the upper bottom rail. Similarly, the middle bottom rail and the lower top rail do not substantially coextend with one another whenever the window is in the closed position as a portion of the lower top rail extends below the middle bottom surface of the middle bottom rail. The frame lacks a head block. A portion of the lower bottom rail extends above the sill whenever the hung window is in the closed position.

BRIEF DESCRIPTION OF THE DRAWINGS

Similar reference numerals refer to similar parts throughout the several views of the drawings.

DESCRIPTION OF THE PREFERRED EMBODIMENT

Figure 1:
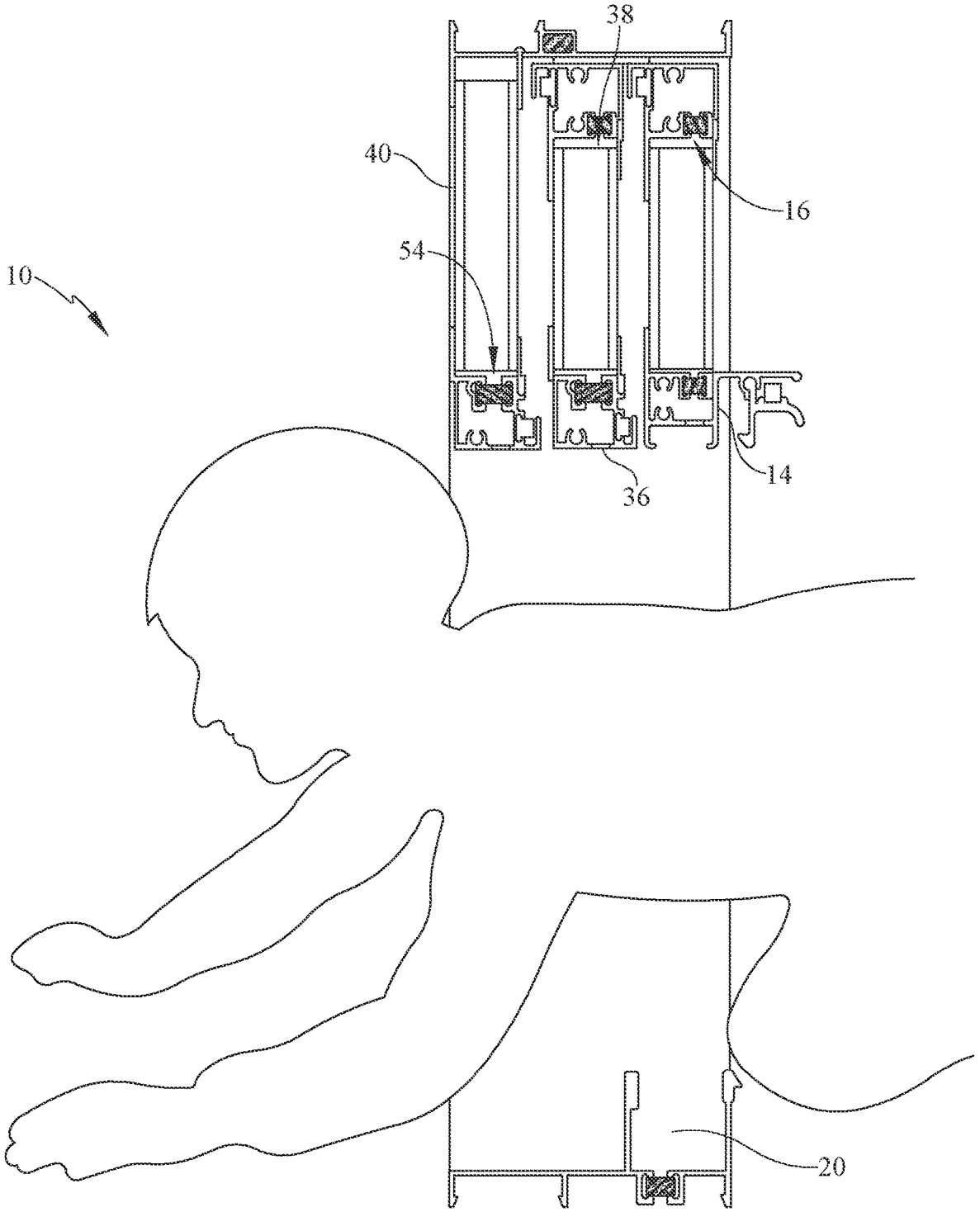
FIG. 1 is an environmental view of a person egressing through the triple sash egress window of the present invention.

Referring now to the drawings, it is seen that the triple sash egress window of the present invention, generally denoted by reference numeral 10, is a typical triple sash window, either double hung or triple hung, with certain features changed relevant to a typical prior art triple sash, double hung or triple hung window. The triple sash egress window 10 of the present invention makes some important changes to the prior art design. First, the profile of the sill seat 12 that receives a lower bottom rail 14 of the lower sash 16 is lowered in height. Basically, the sill seat 12 comprises the various structural flanges 18 that are located below the lower glazing pocket. By having a lower profile of this sill seat 12 of the lower bottom rail 14, the height of the sill 20 is reduced as the sill seat 12 seats within the sill 20 whenever the triple sash egress window 10 is in the closed position. The lowering of the profile of the sill seat 12 of the lower bottom rail 14 reduces the size of the structural cells 22, (or eliminates such cells) so that the structural integrity of the lower bottom rail 14 of the lower sash 16 is reduced, and the lower sash 16 must compensate for this reduction in structural integrity. This compensation is achieved by raising the height of the flanges 24 of the lower glazing pocket. By raising the height of these flanges 24, the contact area between each flange 24 and its respective pane 26 is increased so that the flange 24-pane 26 combination increase the structural integrity of the lower sash 16 thereby offsetting the reduction in structural integrity of the lower sash 16 occasioned by lowering the profile of the sill seat 12. While this does reduce the clear viewing area through the lower part of the lower sash 16 whenever the triple sash window 10 is closed, the critical structural integrity of the lower sash 16 and thus the triple sash egress window 10 is maintained.

Another critical change occurs at the lower top rail 28 of the lower sash 16. As seen, the lower seating flange 30 of the lower top rail 28 is moved to an upper portion of the cell of the lower top rail 28. This means that the lower seating flange is no longer located along a flange of the upper glazing pocket, rather the lower seating flange 30 is located proximate the lower sash top 32 of the lower top rail 28. The lower seating flange 30 otherwise seats within a lower seating pocket 34 located along the middle bottom rail 36 of a middle sash 38. In this configuration, a large portion (even a majority) of the lower top rail 28 of the lower sash 16 is located below the middle bottom rail 36 of the middle sash 38 which means that the lower sash top 32 of the lower top rail 28 is located lower within the window frame 40 relative to a prior art window of the same height. While this reduces the clear viewing area through this part of the triple sash egress window 10 (now both the lower top rail 28 of the lower sash 16 and the middle bottom rail 36 of the middle sash 38 substantially contribute to blocking the view) whenever the triple sash egress window 10 is closed, the lower sash 16 is able to travel a greater distance upwardly prior to reaching the stop 42 extending from the top of the middle top rail 44 of the middle sash 38. When the lower sash 16 is fully raised, its lower bottom rail 14 is substantially coextensive with the middle bottom rail 36 of the middle sash 38 so that there is more clear viewing area at this portion of the triple sash egress window 10—this being true whenever the middle sash 38 is in its lowermost position, as seen in FIG. 3B or its uppermost position as seen in FIG. 3C. More importantly, by having the lower sash 16 travel a greater distance, means that the distance between the top of the sill 20 and the bottom of the lower bottom rail 14 is increased so that the height of the clear vent space is increased whenever the triple sash egress window 10 is fully opened.

Similarly, the middle top rail 44 of the middle sash 38 has its middle seating flange 46 moved to an upper portion of the cell of the middle top rail 44. This means that the middle seating flange is no longer located along a flange of the upper glazing pocket of this sash, rather the middle seating flange 46 is located proximate the middle sash top 48 of the middle top rail 44. The middle seating flange 46 otherwise seats within a middle seating pocket 50 located along the upper bottom rail 52 of an upper sash 54, this upper sash 54 can be fixed as illustrated or can be operable. In this configuration, a large portion (even a majority) of the middle top rail 44 of the middle sash 38 is located below the upper bottom rail 52 of the upper sash 54 which means that the middle sash top 48 of the middle top rail 44 is located lower within the window frame 40 relative to a prior art window of the same height. While this reduces the clear viewing area through this part of the triple sash egress window 10 (now both middle top rail 44 of middle sash 38 and upper bottom rail 52 of upper sash 54 substantially contribute to blocking the view) whenever the triple sash egress window 10 is closed, the middle sash 38 is able to travel a greater distance upwardly prior to reaching the top 56 of the window frame 40. When the middle sash 38 is fully raised, its middle bottom rail 36 is substantially coextensive with the upper bottom rail 52 of the upper sash 54 so that there is more clear viewing area at this portion of the triple sash egress window 10. More importantly, by having the middle sash 38 travel a greater distance (and the lower sash 16 likewise able to travel a greater distance as described), means that the distance between the top of the sill 20 and the bottom of the lower bottom rail 14 of the lower sash 16 and the middle bottom rail 36 of the middle sash 38 is increased so that the height of the clear vent space is increased whenever the triple sash egress window 10 is fully opened.

Figure 2C:
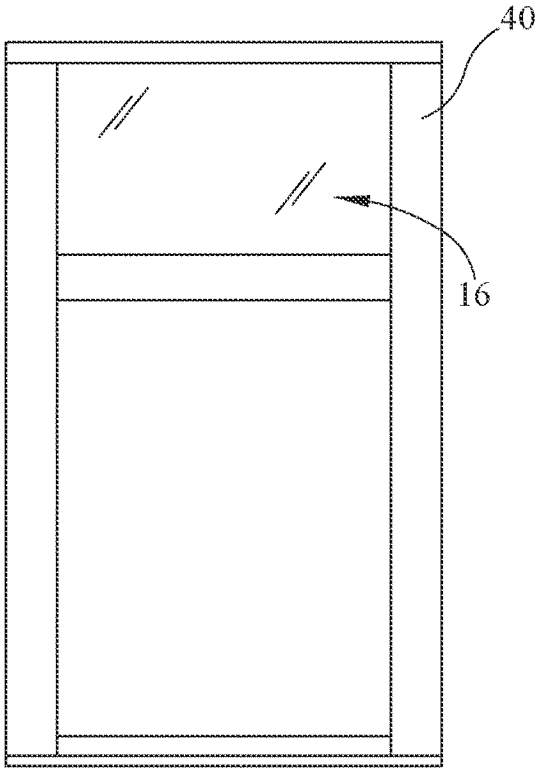
FIG. 2C is a plan view of the triple sash egress window in a fully open position.
Figure 2B:
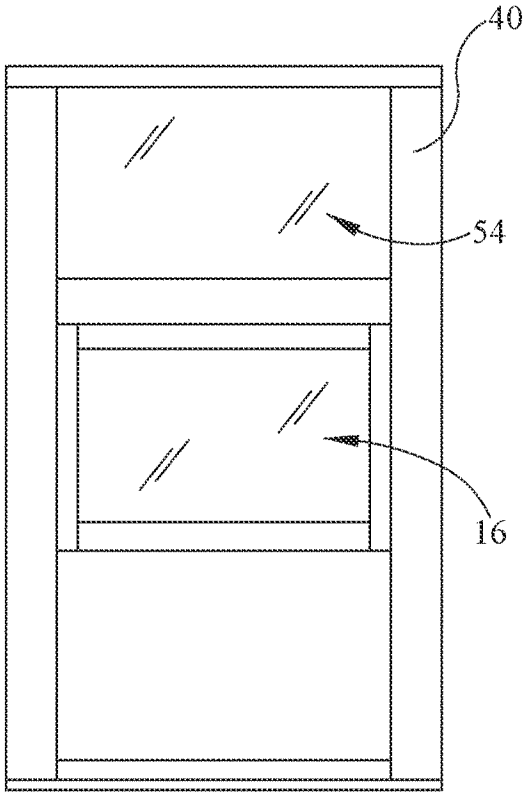
FIG. 2B is a plan view of the triple sash egress window in a partially open position.
Figure 2A:
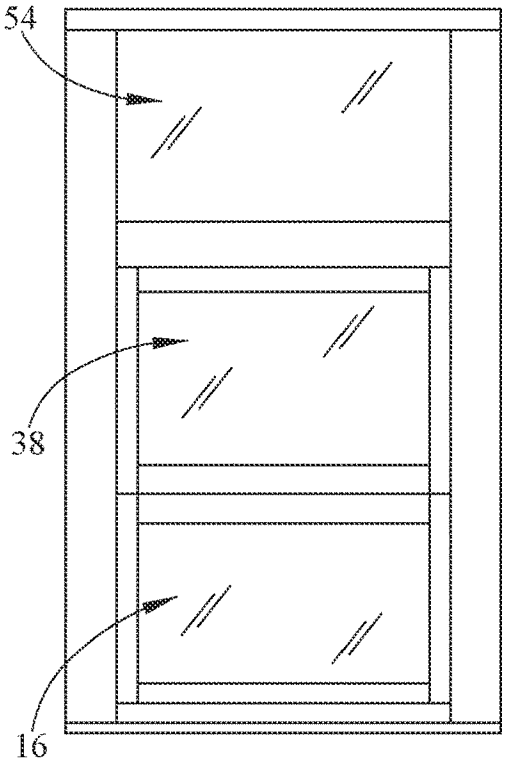
FIG. 2A is a plan view of the triple sash egress window in a closed position.
Figure 3A:
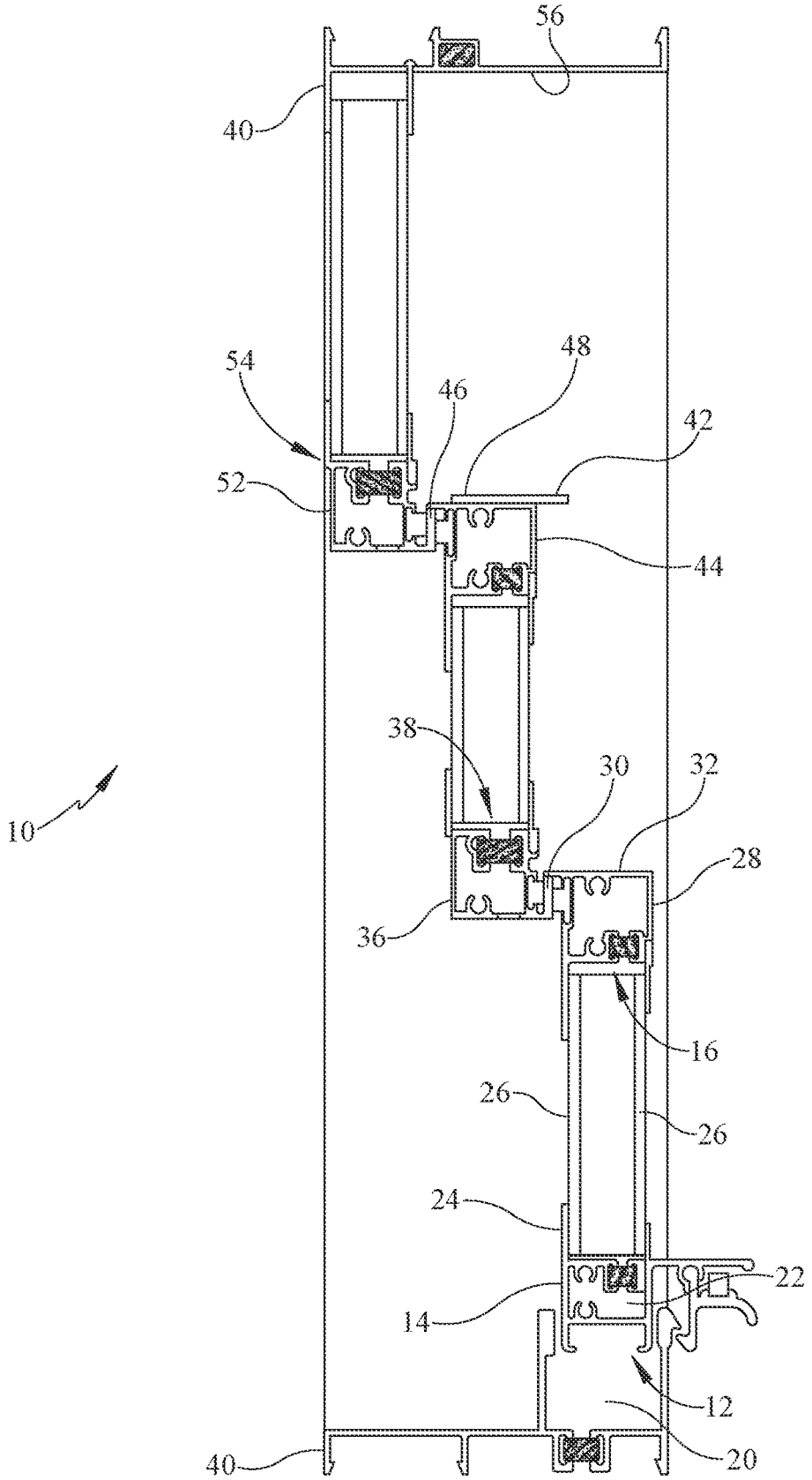
FIG. 3A is a side sectioned view of the triple sash egress window in a closed position.
Figure 3B:
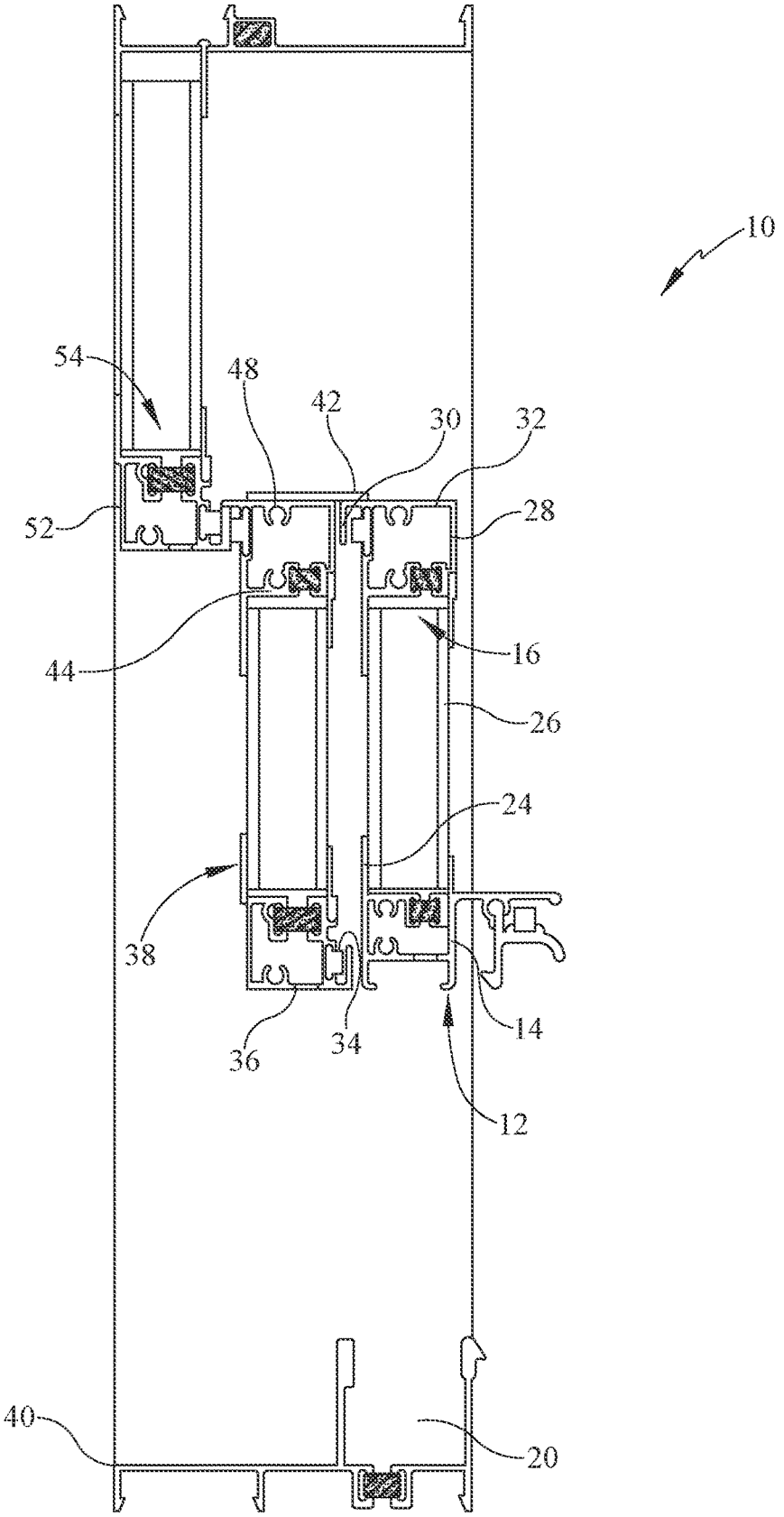
FIG. 3B is a side sectioned view of the triple sash egress window in a partially open position.
Figure 3C:
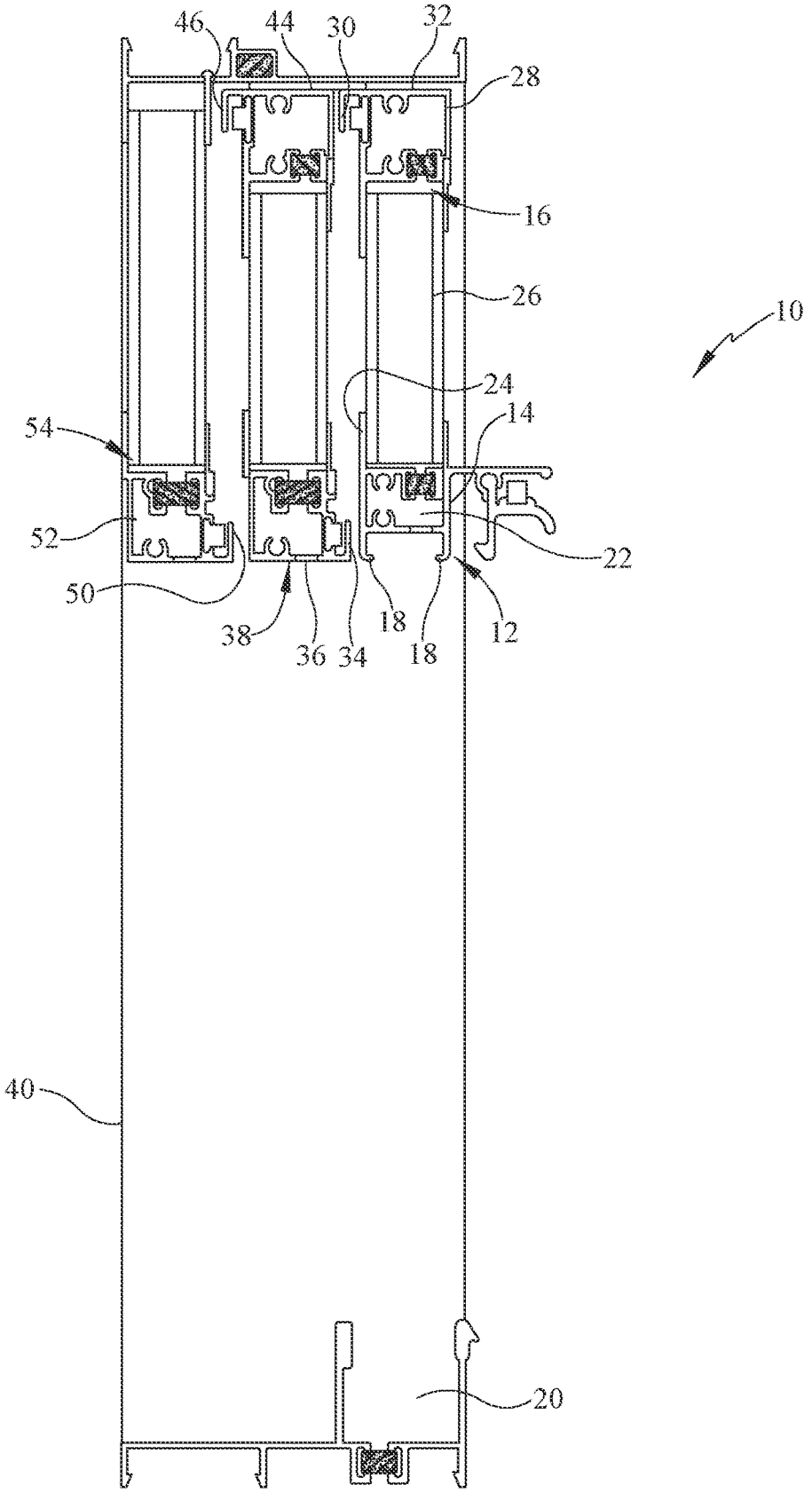
FIG. 3C is a side sectioned view of the triple sash egress window in a fully open position.
Figure 4:
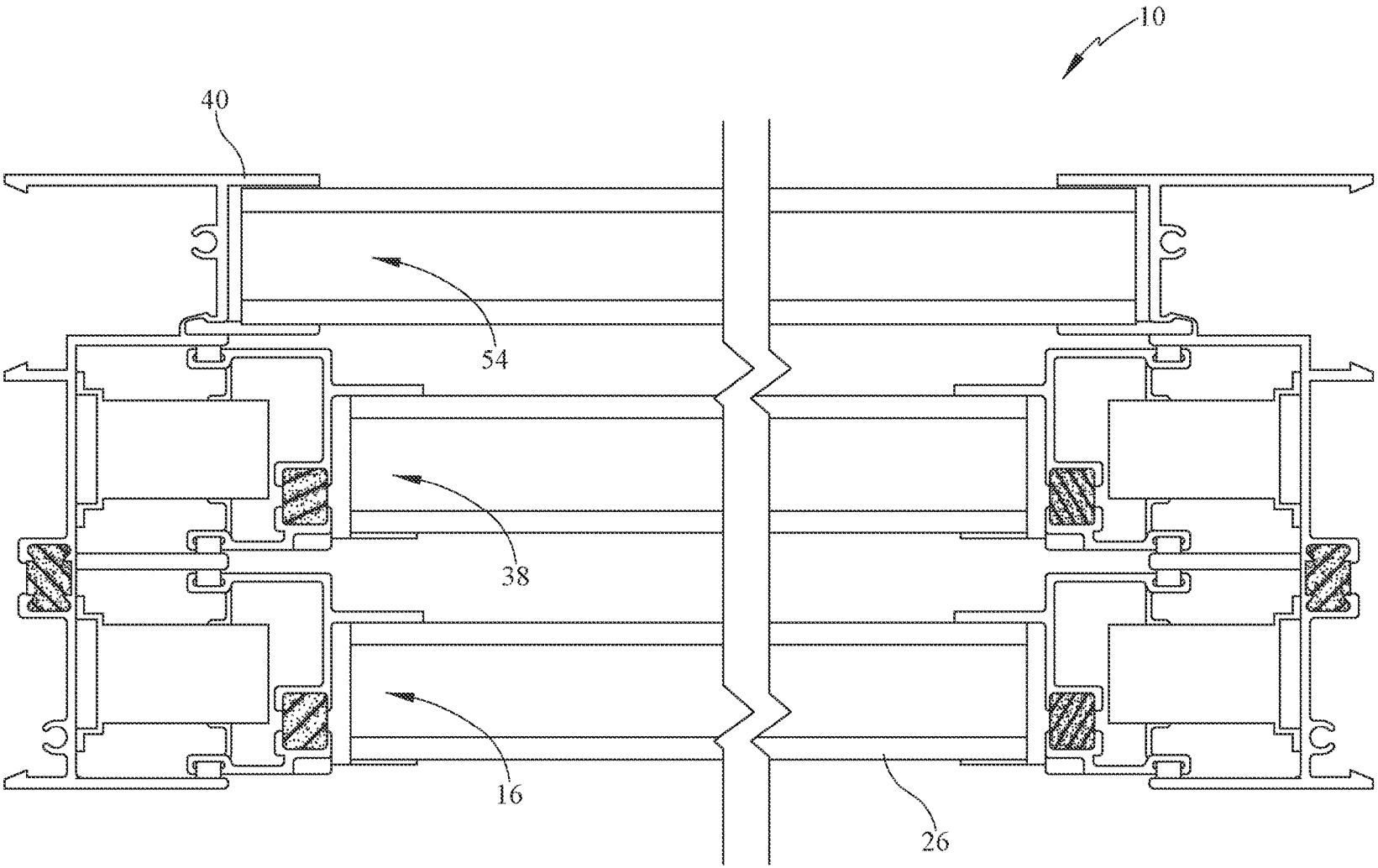
FIG. 4 is a top sectioned view of the relevant components of the triple sash egress window.

Accordingly, as seen in FIGS. 2A and 3A, the triple sash egress window 10 is in a closed position so that the sill seat 12 is received within the sill 20, a portion of the lower top rail 28 of the lower sash 16 is located below the bottom of the middle bottom rail 36 of the middle sash 38, and a portion of the middle top rail 44 of the middle sash 38 is located below the upper bottom rail 52 of the upper sash 54.

In FIGS. 2B and 3B, the lower sash 16 is raised to its maximum height while the middle sash 38 remains closed. As seen, in this position, the lower bottom rail 14 of the lower sash 16 is generally coextensive with the middle bottom rail 36 of the middle sash 38—being coextensive means that neither bottom rail 14 or 36 extends substantially above or below the other sash.

In FIGS. 2C and 3C, the lower sash 16 and the middle sash 38 are each raised to their respective maximum height. As seen, in this position, the lower bottom rail 14 of the lower sash 16 is generally coextensive with the middle bottom rail 36 of the middle sash 38 and each is generally coextensive with the upper bottom rail 52 of the upper sash 54. This open position of the triple sash egress window 10 gives a greater clear space height relative to a similarly sized conventional triple sash window.

Of course, due to the increase of distance traveled by the lower sash 16 and the middle sash 38, the overall length of the balances (not illustrated) attached to the side rails of the frame need to correspondingly increase to allow this greater travel distance.

It is noted that a typical slider window is simply a hung window essentially turned 90 degrees, so that the two movable sashes in the case of a double slider acts as the lower sash and the middle sash of a hung window. The present invention applies to slider windows when width distances are of concern.

The decrease in the height of the sill 20 coupled with the increase in the distance the lower sash 16 and middle sash 38 each travel between the closed and open positions, increases the overall height of the clear vent space relative to the prior art window so that a smaller triple sash egress window 10 can achieve the required vertical clear vent space height relative to the prior art window.

While the invention has been particularly shown and described with reference to an embodiment thereof, it will be appreciated by those skilled in the art that various changes in form and detail may be made without departing from the spirit and scope of the invention.

I claim:

1. A hung window comprising:

a frame having a sill with a sill pocket, the sill located at a base of the frame, the frame also having a frame top located on an opposing end of the frame relative to the base;

an upper sash having an upper top rail and an upper bottom rail, the upper sash disposed within the frame such that the upper top rail is located proximate the frame top, the upper bottom rail having a upper bottom surface facing toward the base, such that a middle seating pocket is located along a first length of the upper bottom rail proximate the upper bottom surface;

a movable lower sash having a lower top rail, the lower top rail having a lower top surface and a lower bottom surface, the lower sash also having a lower bottom rail, the lower sash slidably disposed within the frame, the lower top rail having a lower top surface facing the frame top such that a lower seating flange extends along a second length of the lower top rail proximate the lower top surface;

a movable middle sash having a middle top rail, the middle top rail having a middle top surface and a middle bottom surface, the middle sash also having a middle bottom rail, the middle sash slidably disposed within the frame between the lower sash and the upper sash, the middle top rail having a middle top surface facing the frame top such that a middle seating flange extends along a second length of the middle top rail proximate the top surface, the middle bottom rail having a middle bottom surface facing toward the base, such that a lower seating pocket is located along a first length of the middle bottom rail proximate the middle bottom surface; and the hung window slidable between a closed position wherein the lower bottom rail of the lower sash is seated within the sill pocket and the lower seating flange is seated within the lower seating pocket and the middle seating flange is seated within the middle seating pocket, and a fully open position wherein the middle top surface of the middle top rail of the middle sash abuts the frame top and the lower top surface of the lower top rail abuts the middle bottom surface of the middle top rail without abutting the frame top and such that in the fully open position the upper bottom rail, the middle bottom rail, and the lower bottom rail all substantially coextend with one another.

2. The hung window as in claim 1 wherein the upper bottom rail and the middle top rail do not substantially coextend with one another whenever the hung window is in the closed position as a portion of the middle top rail extends below the upper bottom surface of the upper bottom rail.

3. The hung window as in claim 2 wherein the middle bottom rail and the lower top rail do not substantially coextend with one another whenever the window is in the closed position as a portion of the lower top rail extends below the middle bottom surface of the middle bottom rail.

4. The hung window as in claim 1 wherein the frame lacks a head block.

5. The hung window as in claim 1 wherein a portion of the lower bottom rail extends above the sill whenever the hung window is in the closed position.

6. The hung window as in claim 5 wherein the frame lacks a head block.

* * * * *